US006885268B2

(12) United States Patent
Choi

(10) Patent No.: US 6,885,268 B2
(45) Date of Patent: Apr. 26, 2005

(54) METHOD AND DEVICE FOR COOLING HIGH VOLTAGE TRANSFORMER FOR MICROWAVE OVEN

(75) Inventor: Bu-Sik Choi, Kyungsangbuk-do (KR)

(73) Assignee: Puretec Co., Ltd., Kyungsangbuk-Do (KR)

( * ) Notice: Subject to any disclaimer, the term of this patent is extended or adjusted under 35 U.S.C. 154(b) by 34 days.

(21) Appl. No.: 10/418,134

(22) Filed: Apr. 18, 2003

(65) Prior Publication Data

US 2003/0197583 A1 Oct. 23, 2003

(30) Foreign Application Priority Data

Apr. 23, 2002 (KR) ..... 10-2002-0022109
Sep. 12, 2002 (KR) ..... 10-2002-0055279

(51) Int. Cl.[7] ..... H01F 27/08; H01F 27/10; H01F 27/02

(52) U.S. Cl. ..... 336/57; 336/55; 336/90

(58) Field of Search ..... 336/55, 57, 58, 336/60, 61, 90

(56) References Cited

U.S. PATENT DOCUMENTS 3,629,758 A * 12/1971 Pearce, Jr. ..... 336/57
3,634,798 A * 1/1972 Astleford et al. ..... 336/92
2004/0104218 A1 * 6/2004 Park ..... 219/679

FOREIGN PATENT DOCUMENTS

JP 62229911 A * 10/1987 ..... H01F/27/02

* cited by examiner

*Primary Examiner*—Anh Mai
(74) *Attorney, Agent, or Firm*—Mayer, Brown, Rowe & Maw LLP

(57) ABSTRACT

Disclosed are a method and a device for cooling a high voltage transformer for a microwave oven, in which the high voltage transformer is sealed so as to separate a coil and a core from the outside and to improve a cooling effect, and in which electric connection lines leading from the high voltage transformer are effectively treated and a fixed structure of a container for accommodating the high voltage transformer is improved so as to protect users of the high voltage transformer from dangers such as an electrical shock occurring in inspecting the microwave oven, thereby improving performance and quality of the microwave oven and the high voltage transformer. The method for cooling the high voltage transformer for the microwave oven comprises the steps of: inserting the high voltage transformer into a container with a designated size and sealing the container; injecting a cooling oil into the container so as to absorb heat of a high temperature generated from a coil and a core of the high voltage transformer; and cooling the cooling oil absorbing the heat by radiating the heat via the container exchanging the heat with the outside.

7 Claims, 18 Drawing Sheets

METHOD AND DEVICE FOR COOLING HIGH VOLTAGE TRANSFORMER FOR MICROWAVE OVEN

BACKGROUND OF THE INVENTION

1. Field of the Invention

The present invention relates to a method and a device for cooling a high voltage transformer for a microwave oven, and more particularly to a method and a device for cooling a high voltage transformer for a microwave oven so as to rapidly remove heat generated from a coil and a core in the operation of the high voltage transformer, thereby improving performance and quality of the microwave oven and the high voltage transformer.

2. Description of the Related Art

Generally, high voltage transformers are used in electronic appliances for preparing food using a high frequency, such as microwave ovens. The high voltage transformer is a kind of a power feed unit, which heats a heater of a magnetron for generating high frequency microwave and simultaneously constitutes a half-wave voltage doubler circuit, thereby applying high voltage of 4,000V to the magnetron via a condenser so that the magnetron generates the high frequency microwave.

In a process for manufacturing the above-described high voltage transformer, in order to protect the high voltage transformer from vibration, noise and heat generated by a strong magnetic field occurring when voltage is applied to an input side of the high voltage transformer, an impregnation step, in which the high voltage transformer is impregnated with an impregnant such as varnish, must be performed.

In case the high voltage transformer is manufactured by passing through the aforementioned impregnation step, the process for manufacturing the high voltage transformer is complicated and consequently equipment for manufacturing the high voltage transformer is increased in size. Further, since, in the high voltage transformer manufactured by passing through the impregnation step, the heat generated from the coil is not conducted to the core or the outside, the high voltage transformer is disadvantageous that it is difficult to miniaturize.

The aforementioned high voltage transformer has anther problem. That is, fires frequently break out by the thermosetting of varnish due to the heat. Since the coil charged with electricity is exposed to the outside, the coil is always in danger of fires and electric shocks.

In order to solve such problems, the present inventor(s) filed a method for manufacturing a non-impregnated high voltage transformer. Hereinafter, this patent application will be described with reference to FIGS. 1 and 2.

A plurality of E-type and I-type cores 1 and 2 are continuously manufactured by punching a steel plate 100 using a press, and vertically stacked so that the stack structures of the E-type and I-type cores 1 and 2 have a designated height so as to correspond to a width of a hole of a bobbin 4 to be integrated therewith.

The stack structure of the E-type cores 1 is inserted into the holes of the bobbins 4, provided with coils 5 wound thereon. Then, a two component adhesive 7, which is rapidly cured at room temperature, is coated at a designated amount and thickness on the upper surface of a central supporting portion 1*a* of the stack structure of the E-type cores 1, and the stack structure of the I-type cores 2 is attached to the central portion 1*a* coated with the two component adhesive 7.

Contact portions between both external corners of the upper surfaces of both side supporting portions 1*b* of the stack structure of the E-type cores 1 and both edges of the lower surface of the stack structure of the I-type cores 2 are welded, and several portions along the outer circumferences of the stack structure of the E-type cores 1 and the stack structure of the I-type core 2 are welded, thereby forming several welding areas 8.

An anticorrosive is sprayed on the surfaces of the stack structures of the E-type and I-type cores 1 and 2 and the exposed welding areas 8, thereby forming a rustproof layer 3. Embossed segments 6*a* or rivets 6*b* are used to fix the stack structures of the E-type and I-type cores 1 and 2 so as to form one block, thereby manufacturing a high voltage transformer.

As described above, the process for manufacturing the high voltage transformer without an impregnation step reduces a number of steps, improves productivity of the high voltage transformer, reduces the production cost of the high voltage transformer, and increases quality of the high voltage transformer due to the reduction of vibration and noise generation.

Insulation papers 10 are disposed along the outer surfaces of the coils 5 contacting the stack structures of the E-type cores 1 and I-type cores 2, thereby conducting the heat generated from the coil 5 to the core.

In the above-described conventional high voltage transformer, the insulation papers are used to conduct the heat generated from the coil to the core. However, since the heat generated from the coil is conducted to the core only via the insulation papers, a sufficient cooling rate by the heat conduction is not expected.

That is, the heat generated from the coil is conducted to the core via the insulation papers, and the heated core is cooled by means of a blast fan serving to forcibly cool the heat. However, since a portion of the high voltage transformer mounted on an external device is sealed, the cooling effect due to the forcible cooling using the blast fan is weak.

Particularly, since the high voltage transformer is not sealed but exposed to the outside when the high voltage transformer is mounted on the external device, the high voltage transformer exposes to a user to several dangers, such as an electrical shock, thereby being poor in terms of safety.

SUMMARY OF THE INVENTION

Therefore, the present invention has been made in view of the above problems, and it is an object of the present invention to provide a method and a device for cooling a high voltage transformer for a microwave oven, in which the high voltage transformer is sealed so as to separate a coil and a core from the outside and to improve a cooling effect, and in which electric connection lines leading from the high voltage transformer are effectively treated and a fixed structure of a container for accommodating the high voltage transformer is improved so as to protect the high voltage transformer from dangers such as an electrical shock occurring in inspecting the microwave oven, thereby improving performance and quality of the microwave oven and the high voltage transformer.

In accordance with one aspect of the present invention, the above and other objects can be accomplished by the provision of a method for cooling a high voltage transformer for a microwave oven, comprising the steps of: inserting the high voltage transformer into a container with a designated size and sealing the container; injecting a cooling oil into the container so as to absorb heat of a high temperature generated from a coil and a core of the high voltage transformer; and cooling the cooling oil absorbing the heat by radiating the heat via the container exchanging the heat with the outside.

In accordance, with another aspect of the present invention, there is provided a device for cooling a high voltage transformer for a microwave oven, comprising: a container for accommodating the high voltage transformer; a cooling oil inserted into the container so as to absorb heat of a high temperature generated from a coil and a core of the high voltage transformer; a cover for sealing the container; terminals formed on the upper part of the cover and connected to electrical connection lines leading from the high voltage transformer so as to apply power to the high voltage transformer and to apply power from the high voltage transformer to an end product; and fixing means installed within the container, including a lower guide being disposed on the bottom of the container and serving to support the lower surface of the high voltage transformer so as to prevent the movement of the high voltage transformer and the electrical connection lines leading therefrom, and an upper guide being disposed on the top of the container and serving to support the upper surface of the high voltage transformer and the electrical connection lines.

In accordance with yet another aspect of the present invention, there is provided a device for cooling a high voltage transformer for a microwave oven, comprising: a container for accommodating the high voltage transformer; corrugated portions with concave portions and convex portions, formed in a regular arrangement on each of side surfaces of a case of the container so as to more rapidly cool a cooling oil absorbing heat conducted thereto by convection current; electrical connection lines leading from the high voltage transformer, passing through via holes formed through a cover of the container, each of the said via holes being provided with a protrusion, and protruding to the outside of the cover; bushes inserted into each of the via holes so as to protect the connection wires; and an epoxy filling the insides of the protrusions so as to prevent the cooling oil from flowing thereinto.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
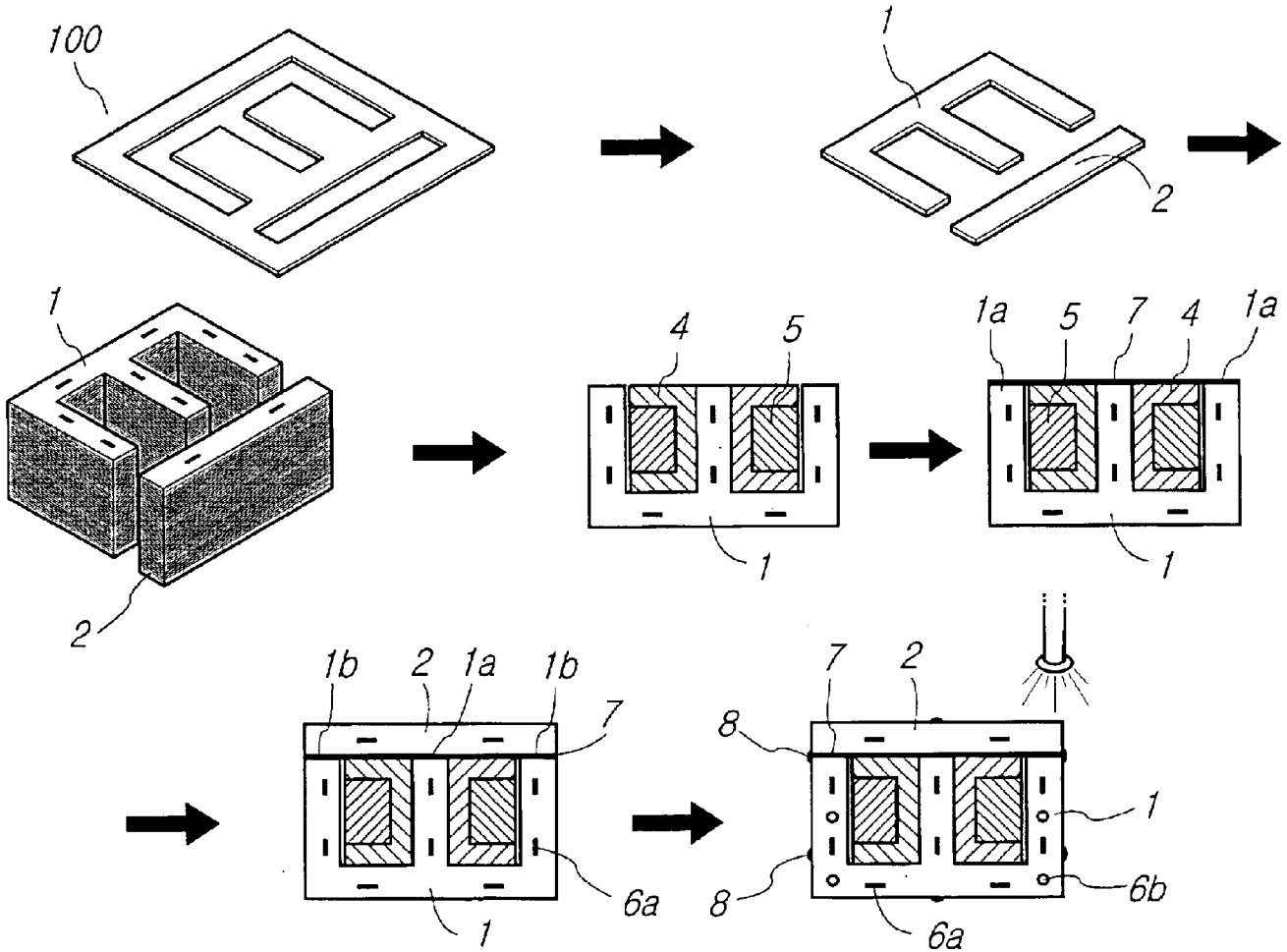
Fig. 1 PRIOR ART
FIG. 1 shows a process for manufacturing a conventional high voltage transformer for a microwave oven.
Figure 2:
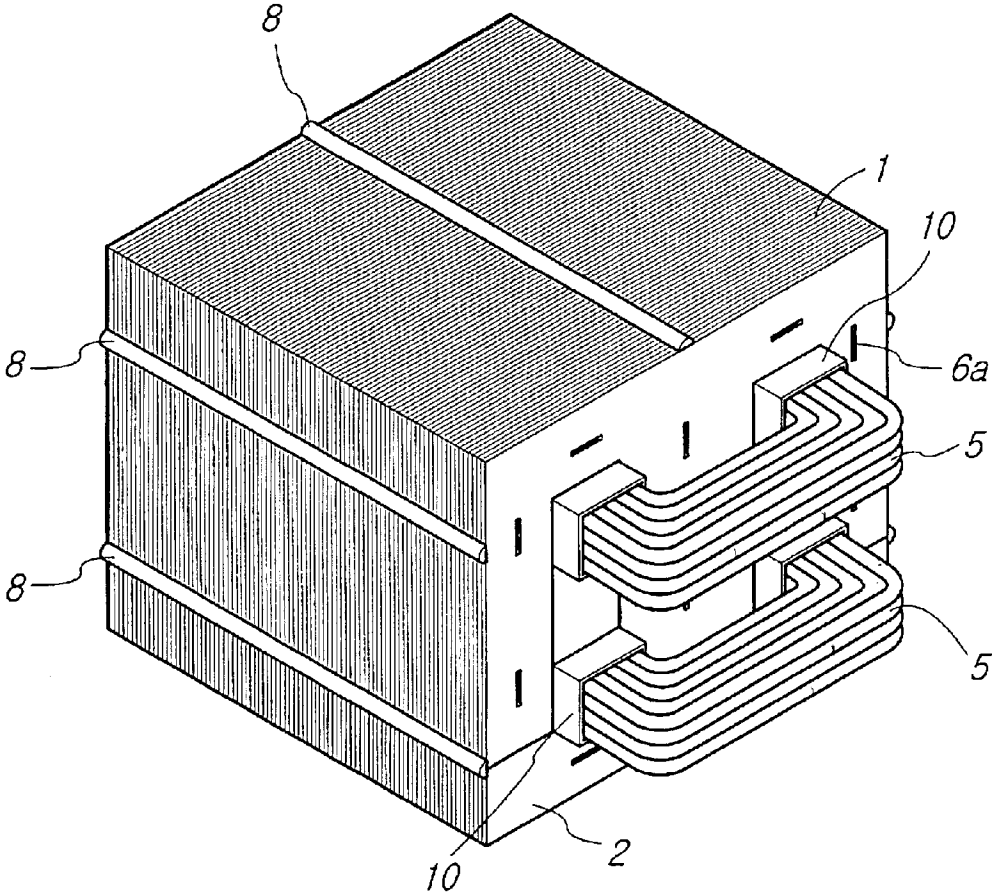
Fig. 2 PRIOR ART
FIG. 2 is a broken-away perspective view of a device for cooling the conventional high voltage transformer for the microwave oven.
Figure 3:
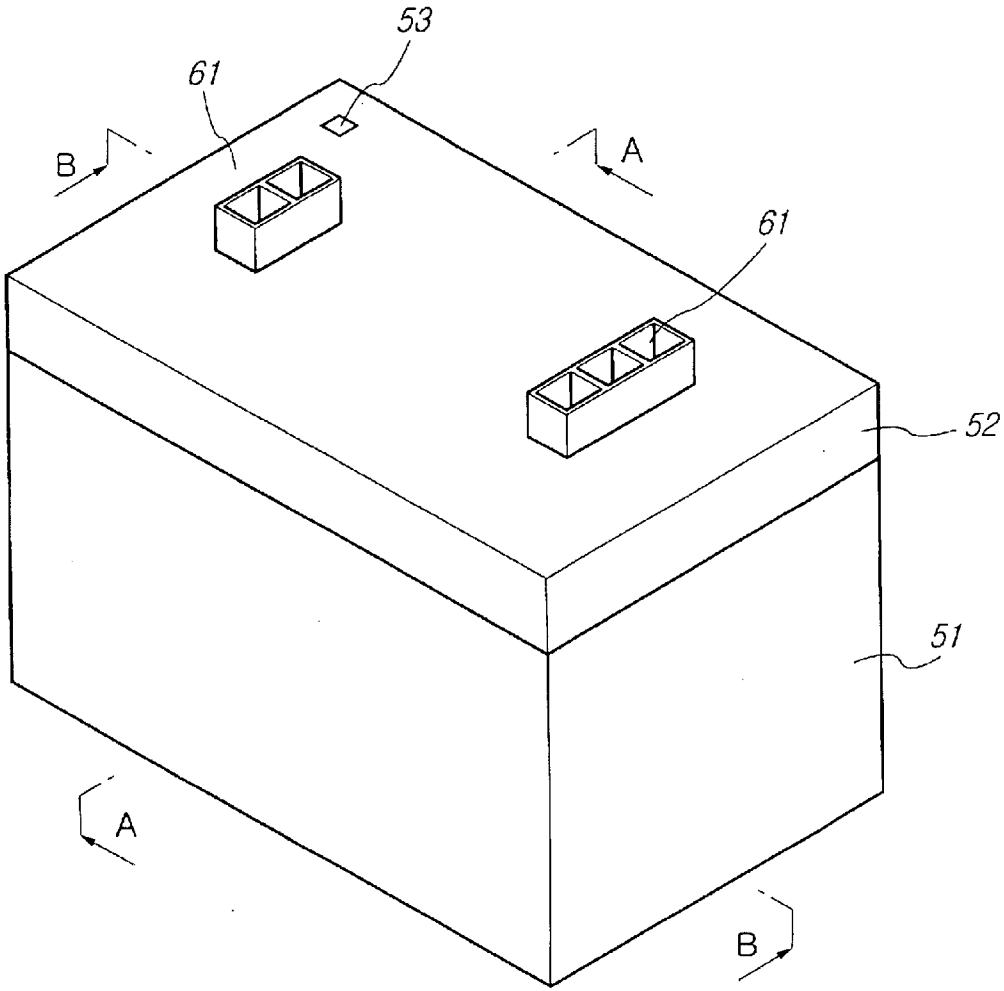
FIG. 3 is a perspective view of a device for cooling a high voltage transformer for a microwave oven in accordance with a first embodiment of the present invention.
Figure 4:
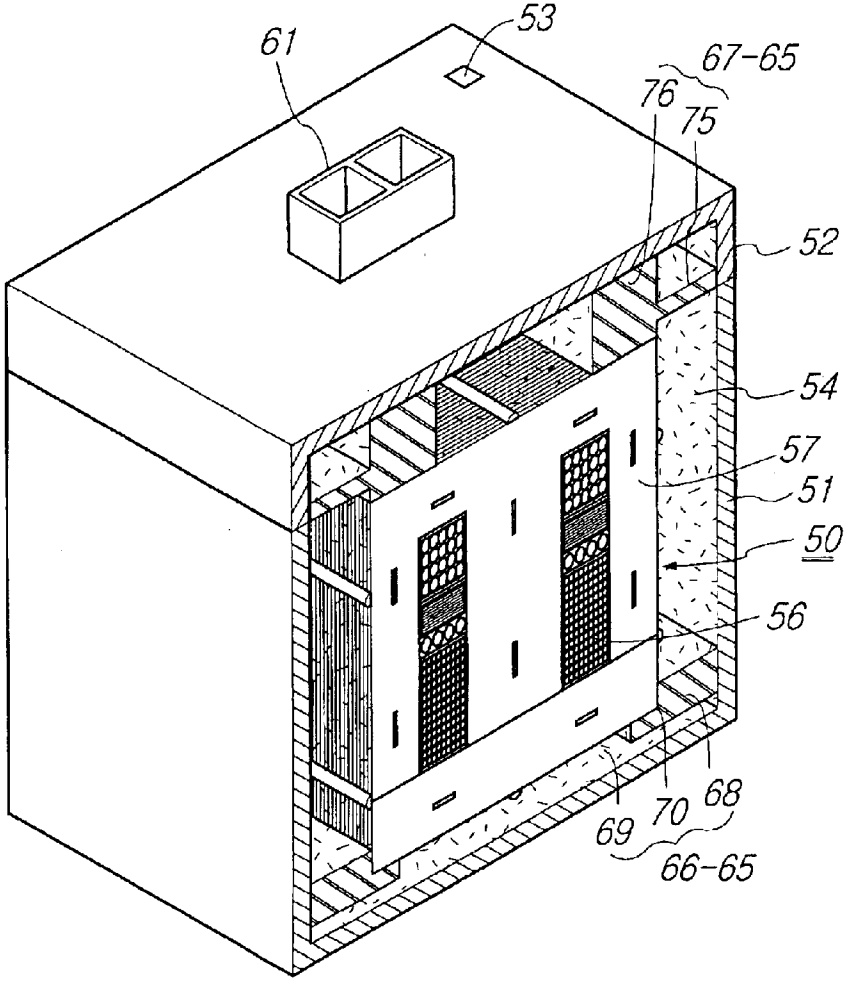
FIG. 4 is a perspective view of the device for cooling the high voltage transformer for the microwave oven, taken along the line A—A, of FIG. 3.
Figure 5:
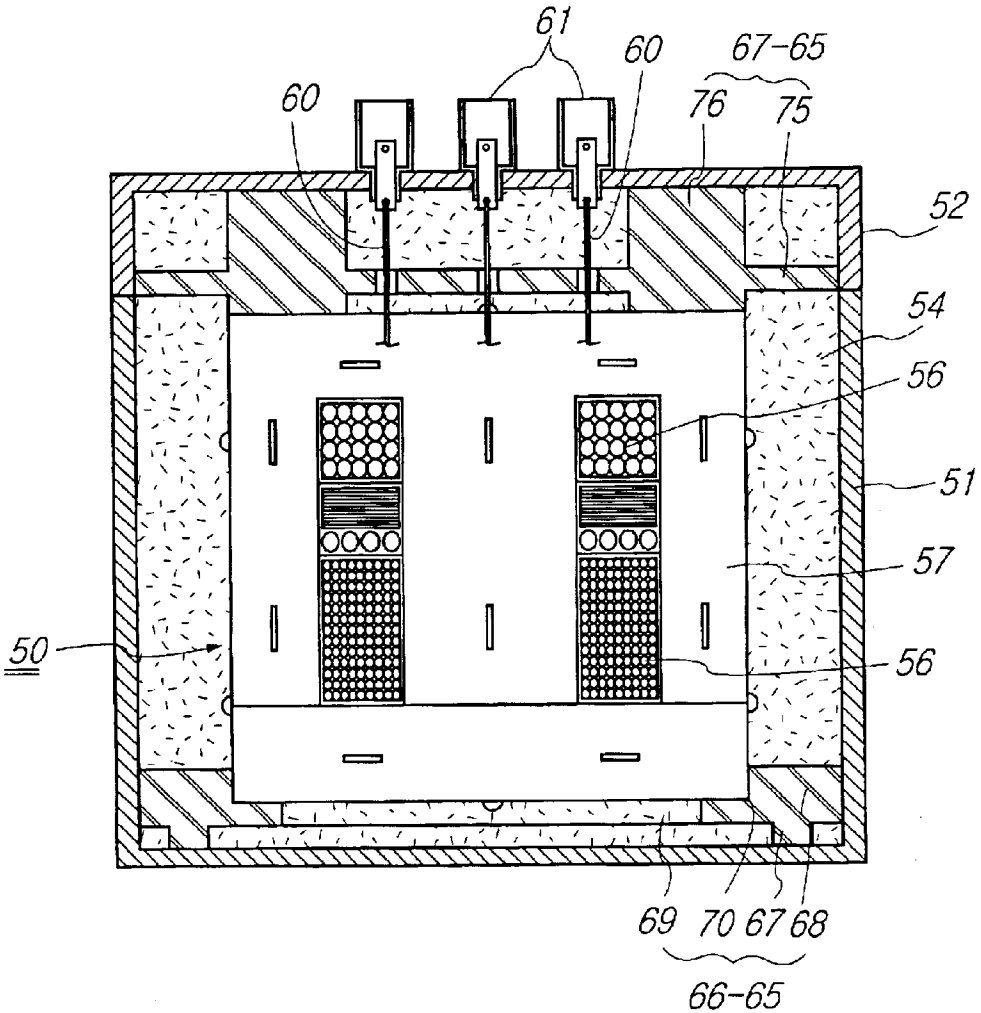
FIG. 5 is a cross-sectional view of the device for cooling the high voltage transformer for the microwave oven, taken along the line B—B, of FIG. 3.
Figure 6:
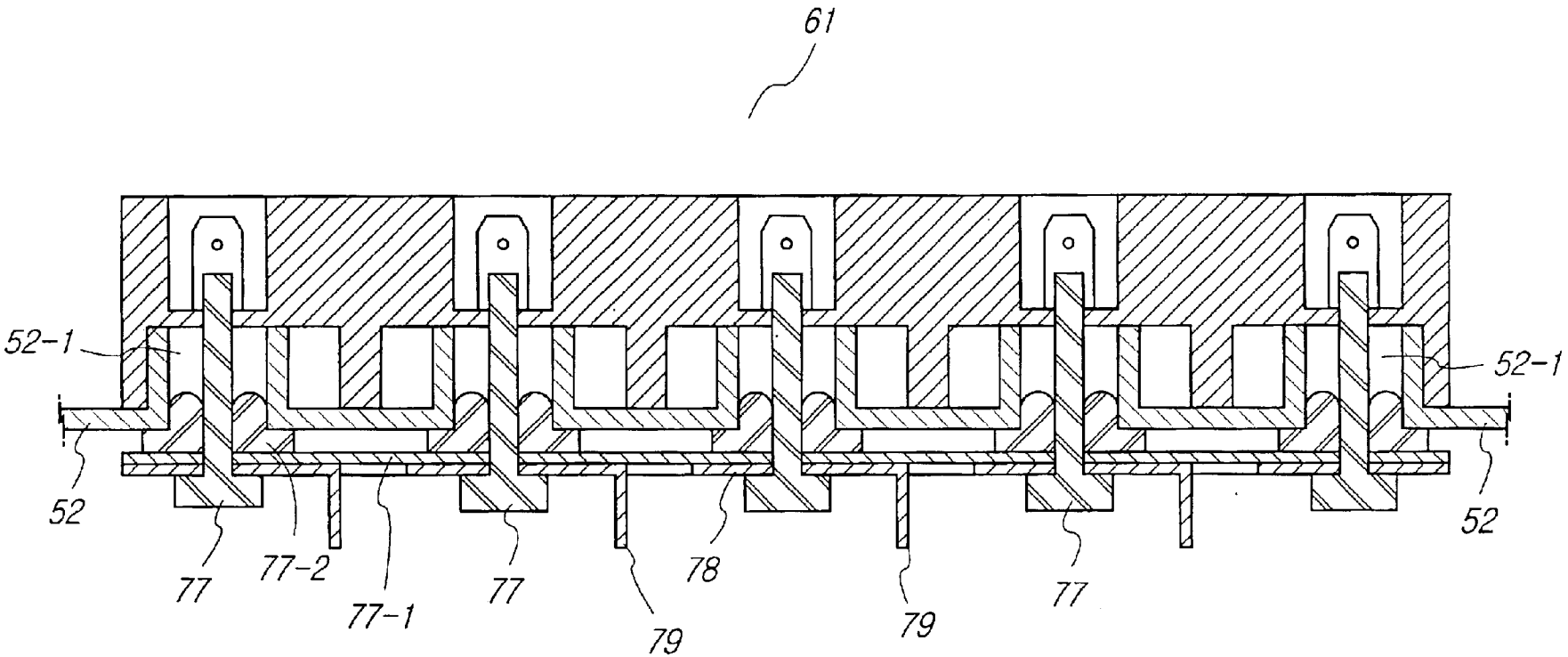
FIG. 6 is a cross-sectional view showing another example of a terminal for leading an electric connection line of the device for cooling the high voltage transformer for the microwave oven of FIG. 3.
Figure 7:
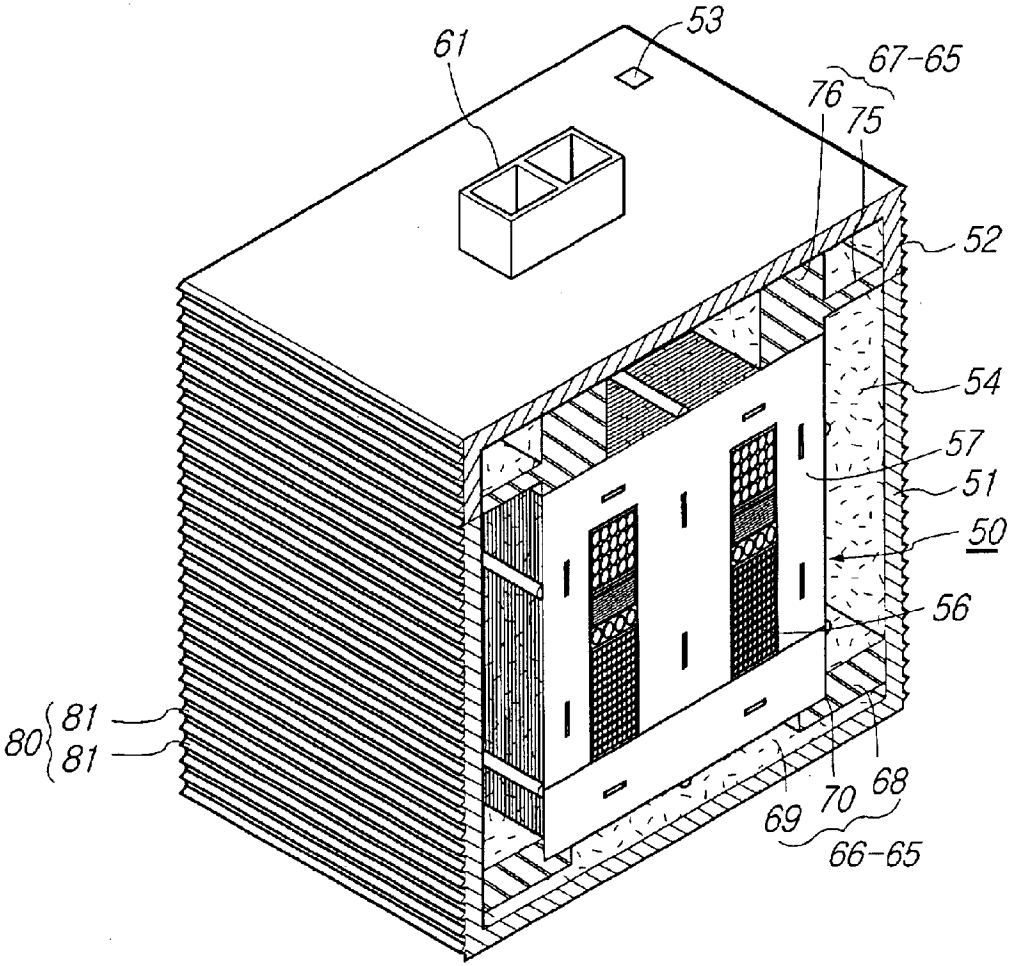
FIG. 7 is a broken-away perspective view showing another example of a container applied to the device for cooling the high voltage transformer for the microwave oven of FIG. 3.
Figure 8:
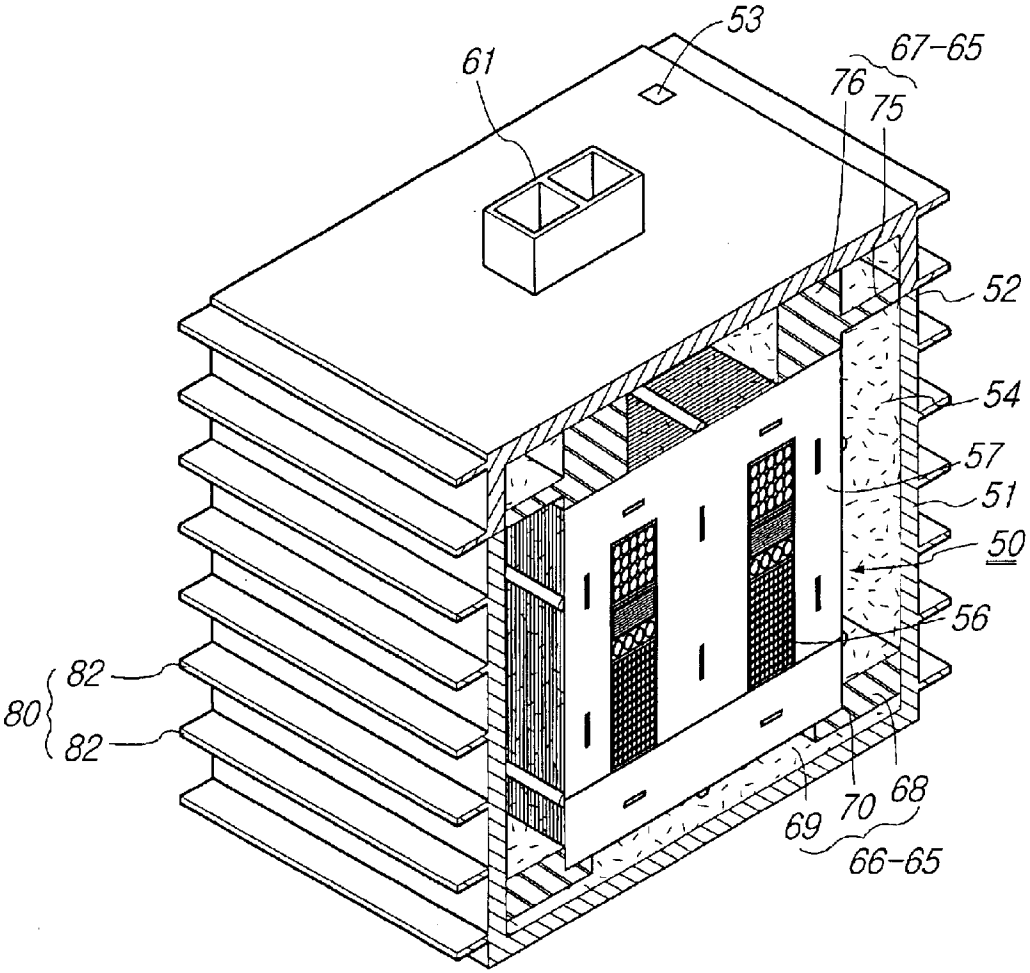
FIG. 8 is a broken-away perspective view showing yet another example of a container applied to the device for cooling the high voltage transformer for the microwave oven of FIG. 3.

FIG. 3 is a perspective view of a device for cooling a high voltage transformer for a microwave oven in accordance with a first embodiment of the present invention. FIG. 4 is a perspective view of the device for cooling the high voltage transformer for the microwave oven, taken along the line A—A, of FIG. 3, and FIG. 5 is a cross-sectional view of the device for cooling the high voltage transformer for the microwave oven, taken along the line B—B, of FIG. 3. FIG. 6 is a cross-sectional view showing another example of a terminal for leading an electric connection line of the device for cooling the high voltage transformer for the microwave oven of FIG. 3. FIG. 7 is a broken-away perspective view showing another example of a container applied to the device for cooling the high voltage transformer for the microwave oven of FIG. 3, and FIG. 8 is a broken-away perspective view showing yet another example of a container applied to the device for cooling the high voltage transformer for the microwave oven of FIG. 3.

A non-impregnated high voltage transformer 50 of the present invention is manufactured by continuously punching a steel plate by a press so as to form E-type and I-type thin plates, by stacking the E-type and I-type thin plates so as to form E-type and I-type cores, by inserting first and second coils into the E-type core and inserting a pass core and a heater coil into the first and second coils, and by attaching the I-type core to the E-type core using a two component adhesive.

In order to prevent the separation of the E-type and I-type cores, contact portions between the E-type core and the I-type core and several portions along the outer circumferences of the E-type and I-type cores are welded. Then, embossed segments or rivets are used to fix the E-type and I-type cores in a stacking direction. An anticorrosive is sprayed on the surfaces of the E-type and I-type cores and the exposed welding portions, thereby protecting the manufactured high voltage transformer from corrosion, vibration and noise. By the above process, the manufacturing of the high voltage transformer is completed.

The high voltage transformer 50 manufactured by the above-described process is accommodated within a container 51 with a designated size so as to receive the high voltage transformer 50 therein. The container 51 is sealed with a cover 52, and a cooling oil 54 is injected into the container 51 via an injection port 53 formed in the cover 52. Then, the injection port 53 is sealed. The cooling oil 54 injected into the container 51 absorbs heat of a high temperature generated from a coil 56 and a core 57 of the high voltage transformer 50, and then radiates the absorbed heat via the container 51 and the cover 52, thereby serving to cool the high voltage transformer 50.

Electrical connection lines 60 are connected to terminals 61 provided on the upper surface of the cover 52 so as to supply power to the high voltage transformer 50 and to supply the power from the high voltage transformer 50 to an end external device.

Preferably, the container 51 is made of a material with excellent thermal conductivity such as aluminum or thermally rolled steel plate, and the cooling oil 54 injected into the container 51 is a nonconductive and incombustible cooling oil. Fixing means 65 is further provided within the container 51 so as to fix the high voltage transformer 50 and the electrical connection lines 60 leading from the transformer 50 and to maintain a gap between the high voltage transformer 50 and the container 51.

The fixing means 65 comprises a lower guide 66 disposed on the bottom of the container 51 so as to support the lower surface of the high voltage transformer 50, and a upper guide 67 disposed on the top of the container 51 so as to support the upper surface of the high voltage transformer 50 and the electrical connection lines 60.

The lower guide 66 includes a base 68 formed as a think film and made of a fire retarding material by molding, provided with legs 67 protruding therefrom, and a through hole 69 formed in the center of the base 68 so that the cooling oil 54 is injected to the container 51 therethrough.

A dented step 70 is formed along the edge of the through hole 69 so as to receive and guide the edge of the lower surface of the high voltage transformer 50. Otherwise, L-type dented steps may be respectively formed on only four corners of the bottom of the container 51 so as to guide four corners of the lower surface of the high voltage transformer 50.

The lower guide 67 includes a flat base 75 made of a fire retarding material by molding, and ribs 76 protruding from the upper and lower surfaces of the base 75 and so as to compensate the gap between the upper surface of the high voltage transformer 50 and the cover 52.

Generally, the terminals 61 include two or three units separated from each other by a designated distance. In case the terminals 61 include five units separated from each other and integrated into one block, the terminals 61 are advantageous in terms of automation of cooling the high voltage transformer 50, and operation efficiency and productivity of the device for cooling the high voltage transformer 50. However, in this case, since a distance between pins 77 connected to the electrical connection lines 60 7 is short, the terminals 61 is influenced by breakdown voltage.

Herein, an upper insulation paper 77-1 is disposed below pin holes 52-1 formed through the cover 52, and a lower insulation paper 78 is disposed on the lower surfaces of heads of the pins 77 fixed to the pin holes 52-1 by means of packings 77-2. The lower insulation paper 78 is cut at areas between the pins 77, and the cut portions of the lower insulation paper 78 are downwardly bent. The downwardly bent portions 79 of the lower insulation paper 78 serve to guarantee a sufficient insulation distance between the pins 77.

FIGS. 7 and 8 show auxiliary cooling means 80 for rapidly cooling the cooling oil 54 absorbing the heat generated from the coil 56 and the core 57, installed on the external surface of the container 51 accommodating the high voltage transformer 50.

The auxiliary cooling means 80 may include a plurality of folds 81 formed integrally with the container 51 as shown in FIG. 7, or a plurality of radiation fins 82 formed on the external surface of the container 51 and separated from each other by the same distance as shown in FIG. 8, thereby rapidly cooling the container 51 absorbing the heat conducted from the cooling oil 54 in forcibly cooling the heat by means of a blast fan.

Figure 9:
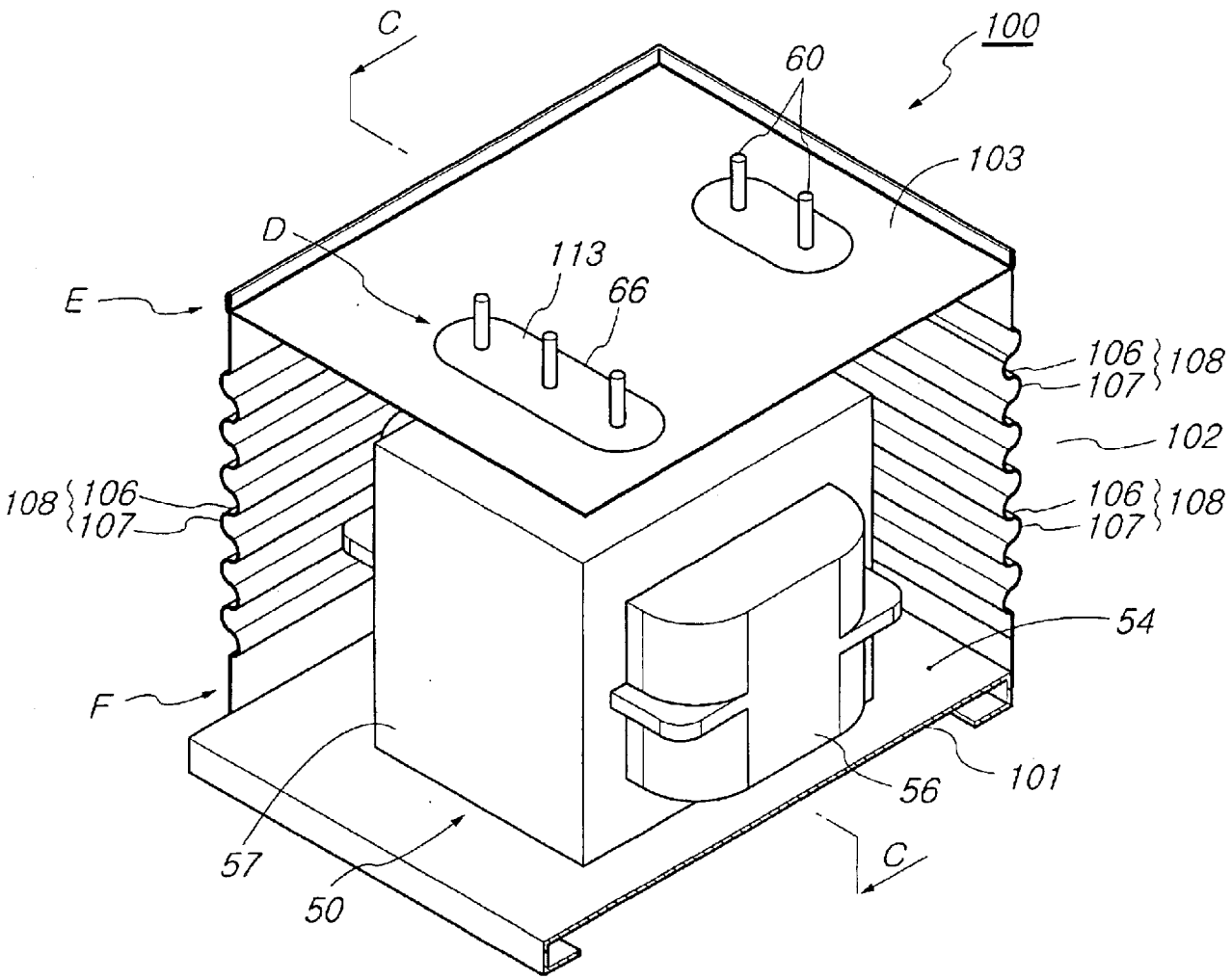
FIG. 9 is a partially broken-away perspective view of a device for cooling a high voltage transformer for a microwave oven in accordance with a second embodiment of the present invention.
Figure 10:
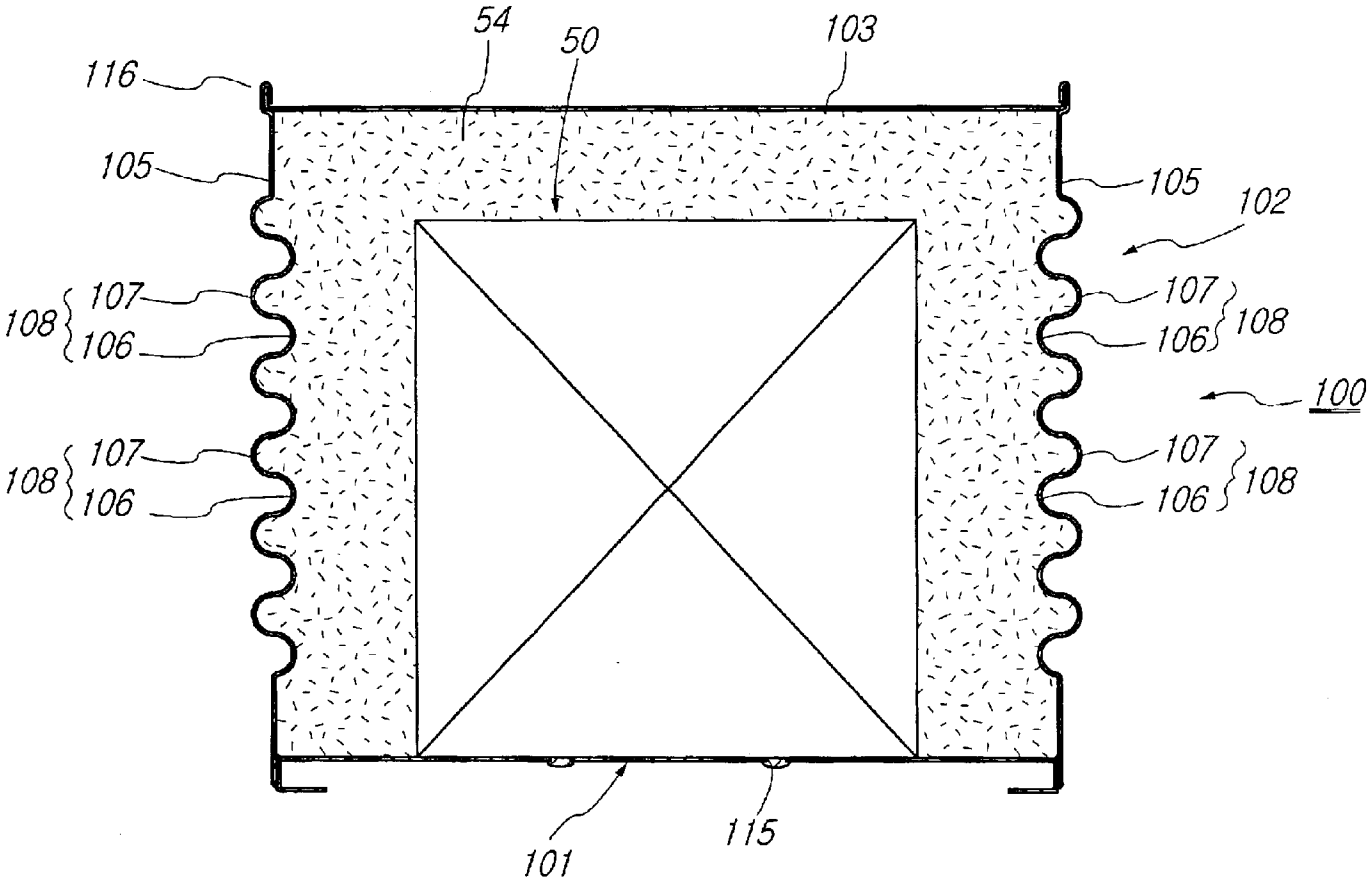
FIG. 10 is a cross-sectional of the device for cooling the high voltage transformer for the microwave oven, in which inner components are omitted, taken along the line C—C, of FIG. 9.
Figure 11:
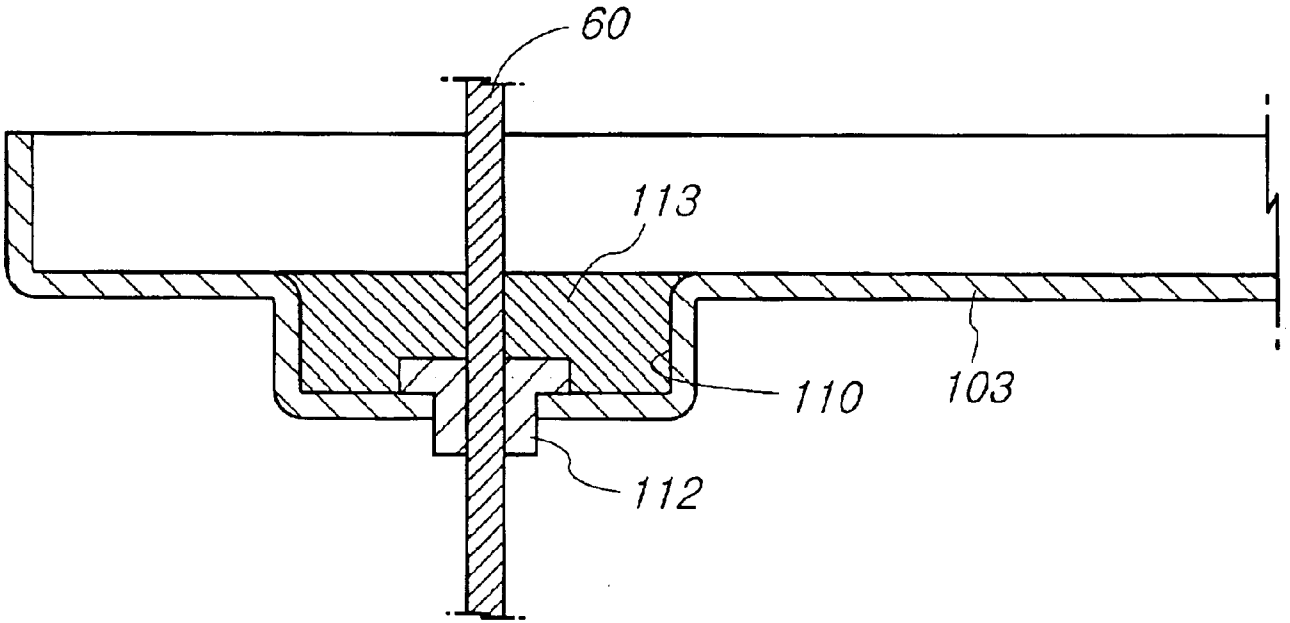
FIG. 11 is an enlarged cross-sectional view of an example of the portion D of the device for cooling the high voltage transformer for the microwave oven of FIG. 9.
Figure 12:
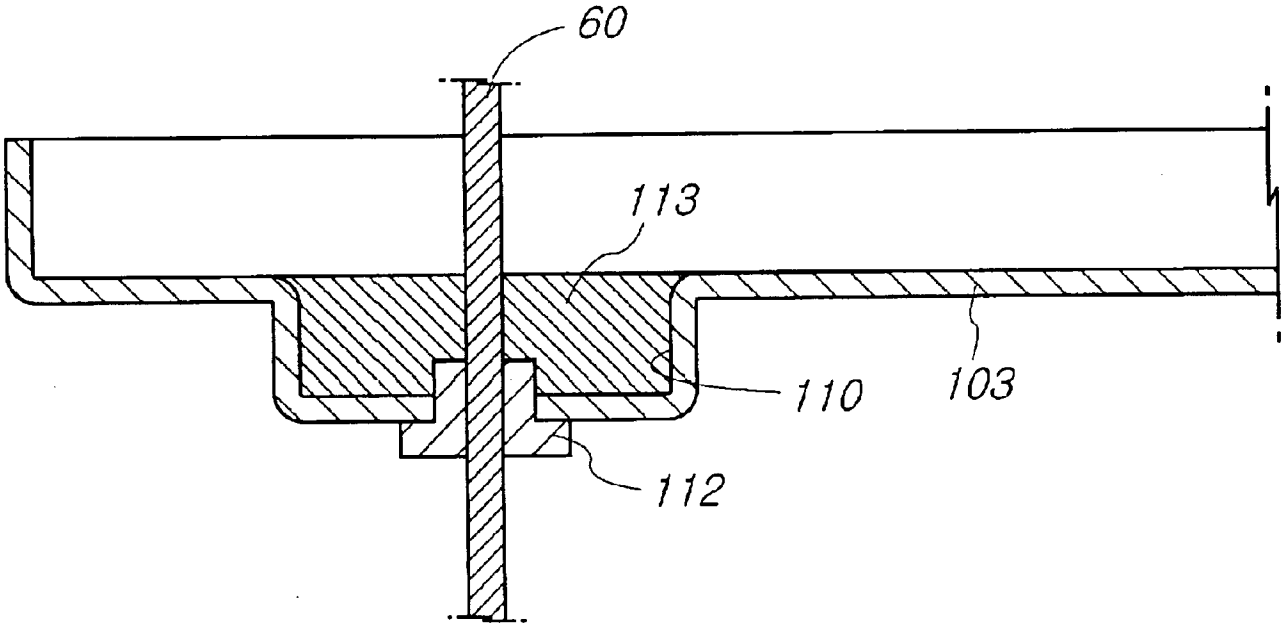
FIG. 12 is an enlarged cross-sectional view of another example of the portion D of the device for cooling the high voltage transformer for the microwave oven of FIG. 9.
Figure 13:
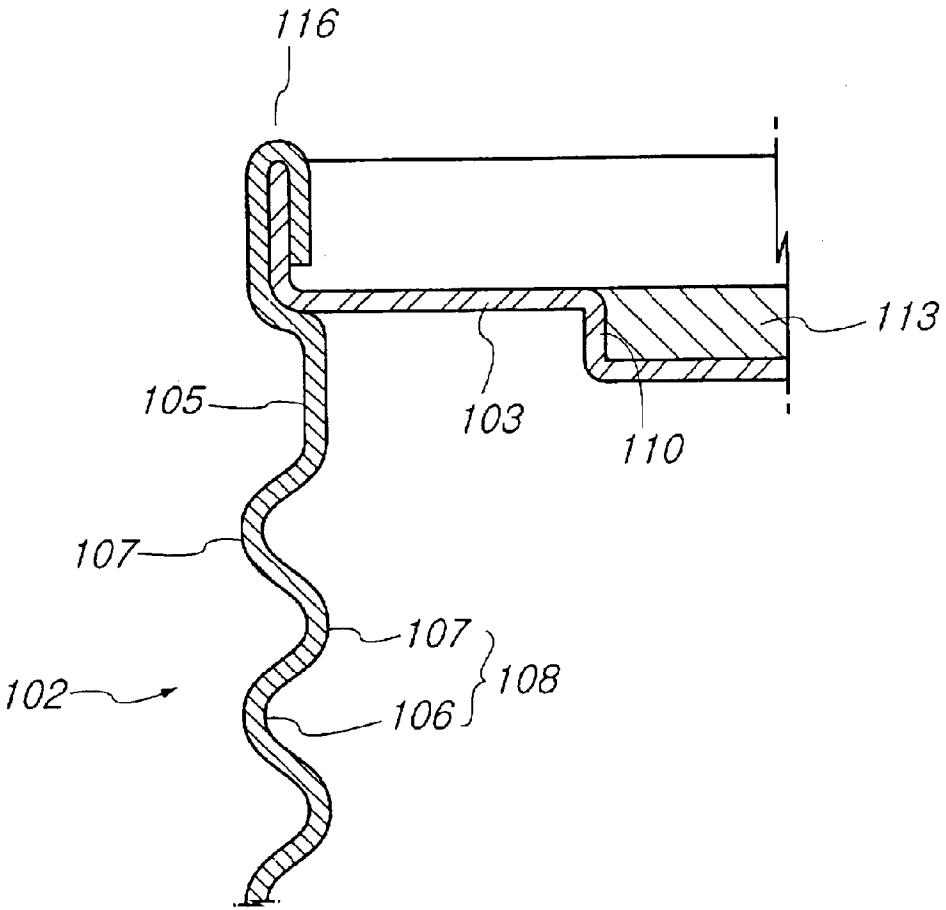
FIG. 13 is an enlarged cross-sectional view of an example of the portion E of the device for cooling the high voltage transformer for the microwave oven of FIG. 9.
Figure 14:
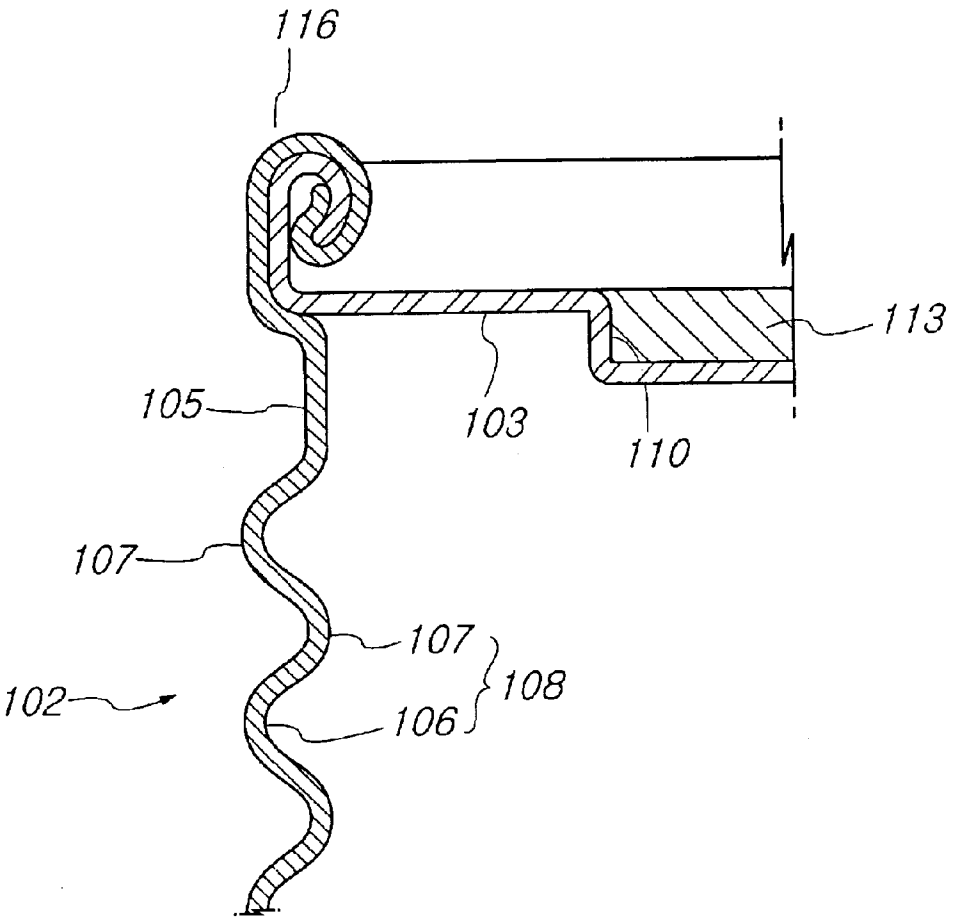
FIG. 14 is an enlarged cross-sectional view of another example of the portion E of the device for cooling the high voltage transformer for the microwave oven of FIG. 9.
Figure 15:
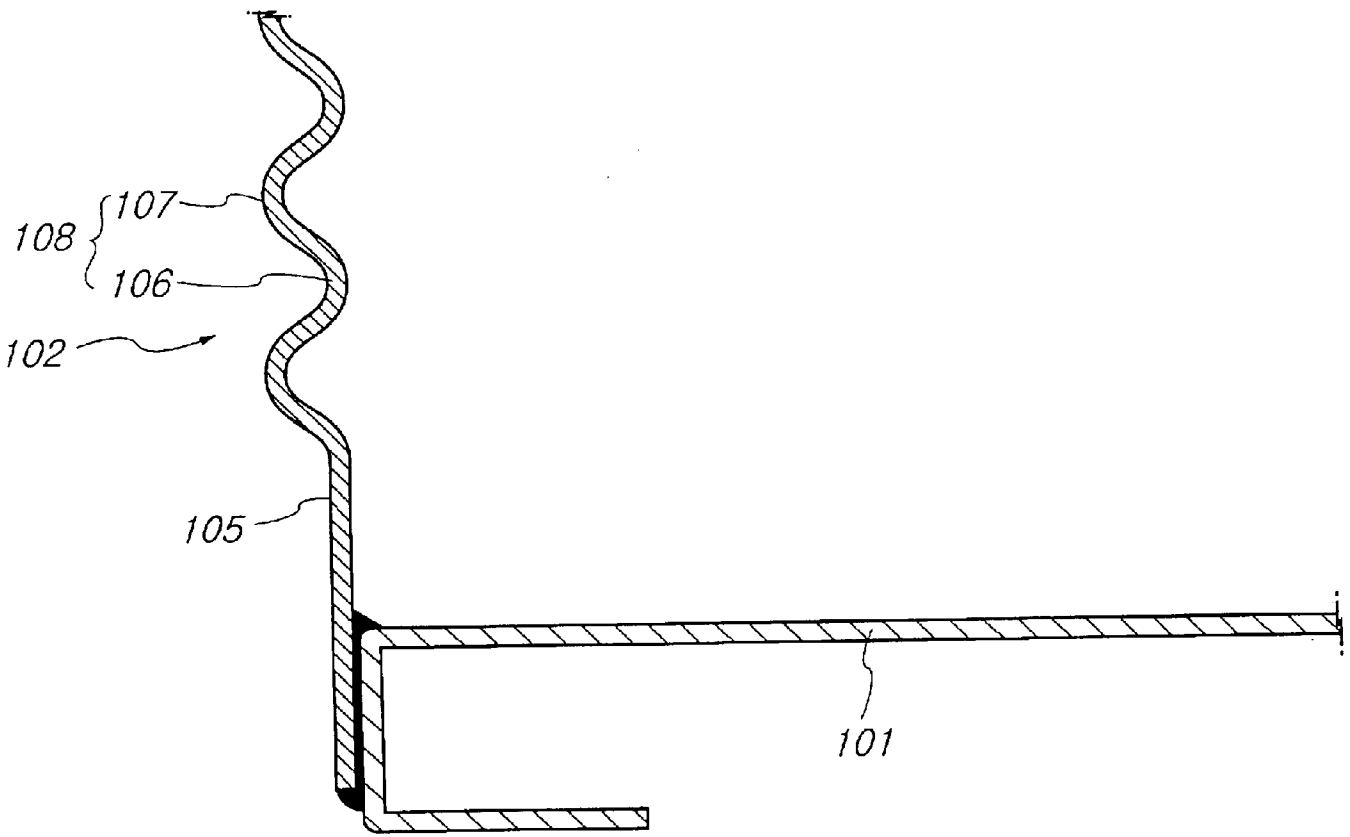
FIG. 15 is an enlarged cross-sectional view of an example of the portion F of the device for cooling the high voltage transformer for the microwave oven of FIG. 9.
Figure 16:
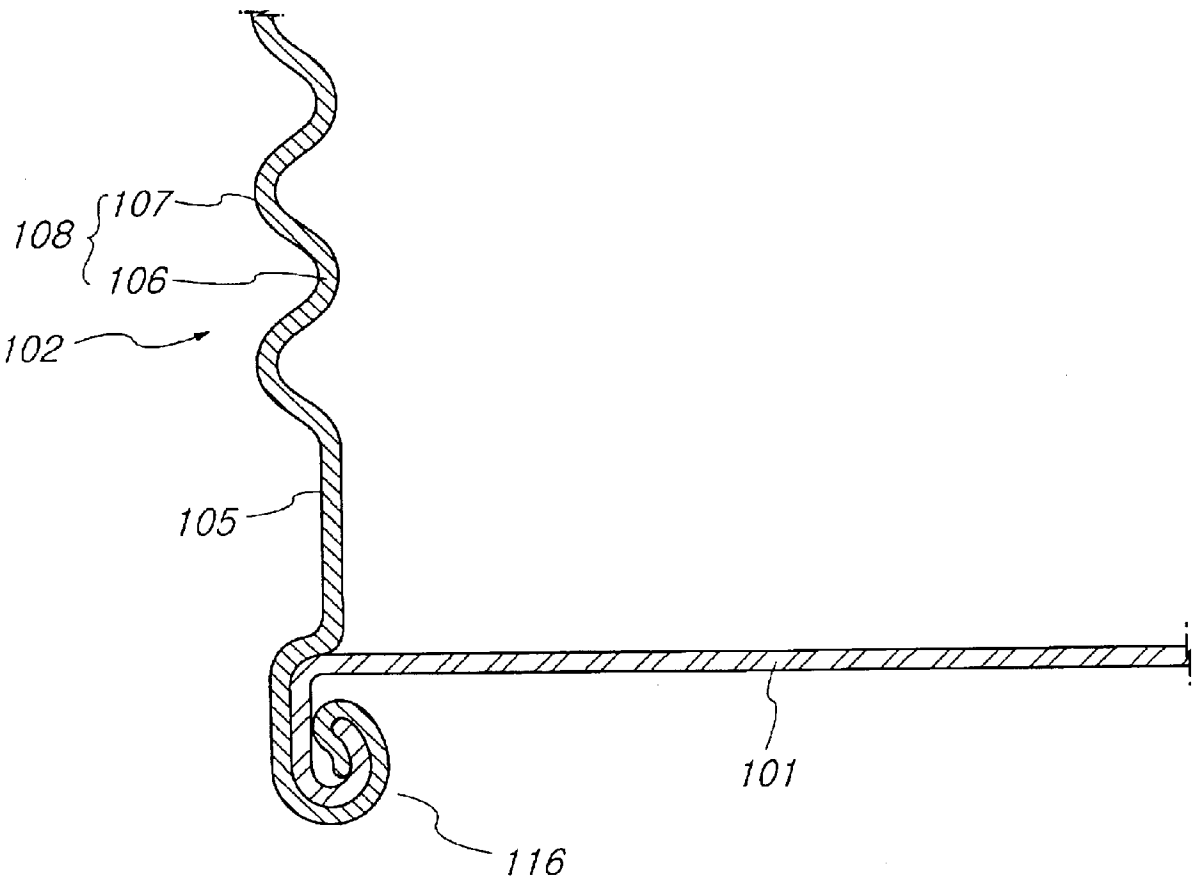
FIG. 16 is an enlarged cross-sectional view of another example of the portion F of the device for cooling the high voltage transformer for the microwave oven of FIG. 9.
Figure 17:
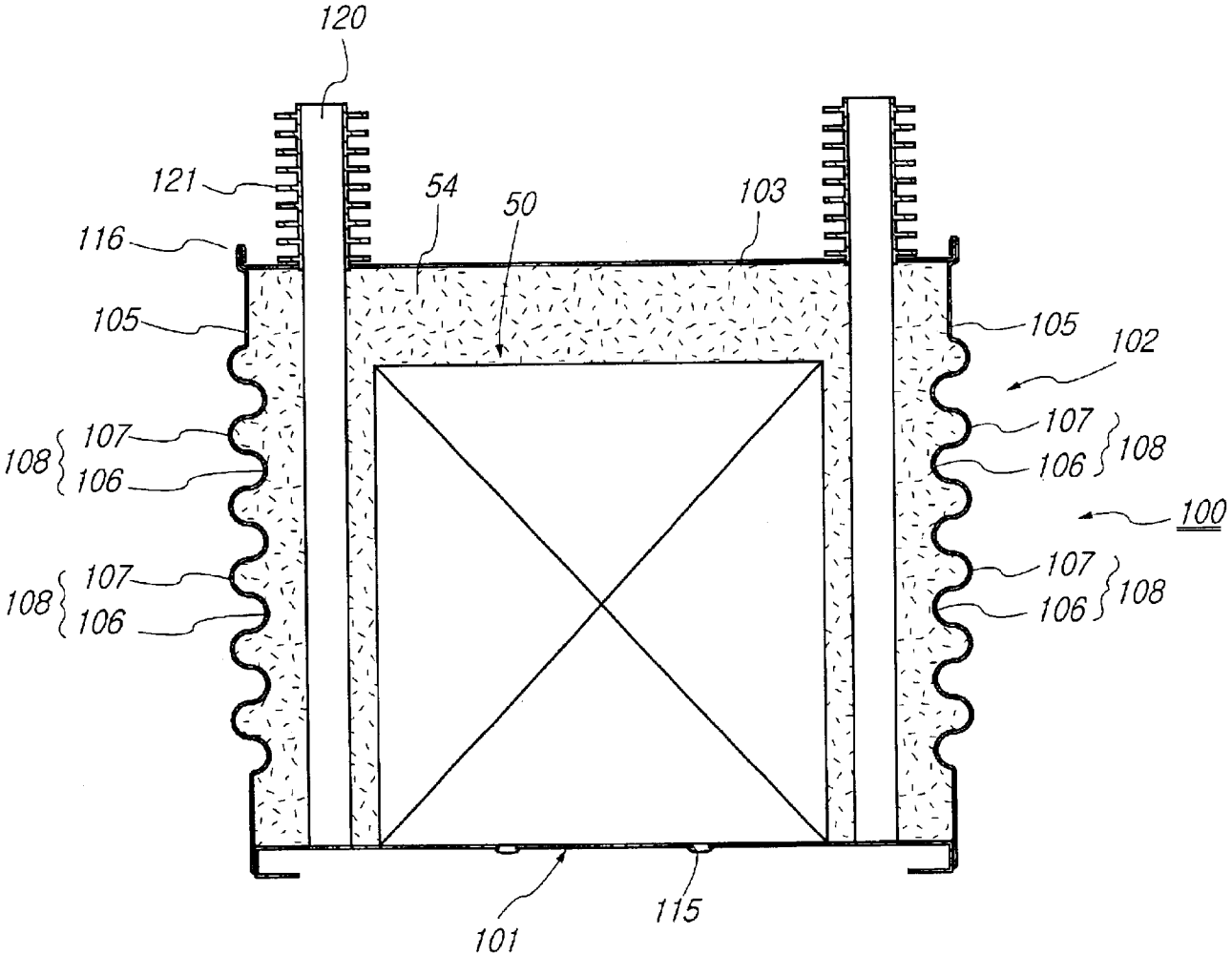
FIG. 17 is a cross-sectional view of a device for cooling a high voltage transformer for a microwave oven in accordance with a third embodiment of the present invention.
Figure 18:
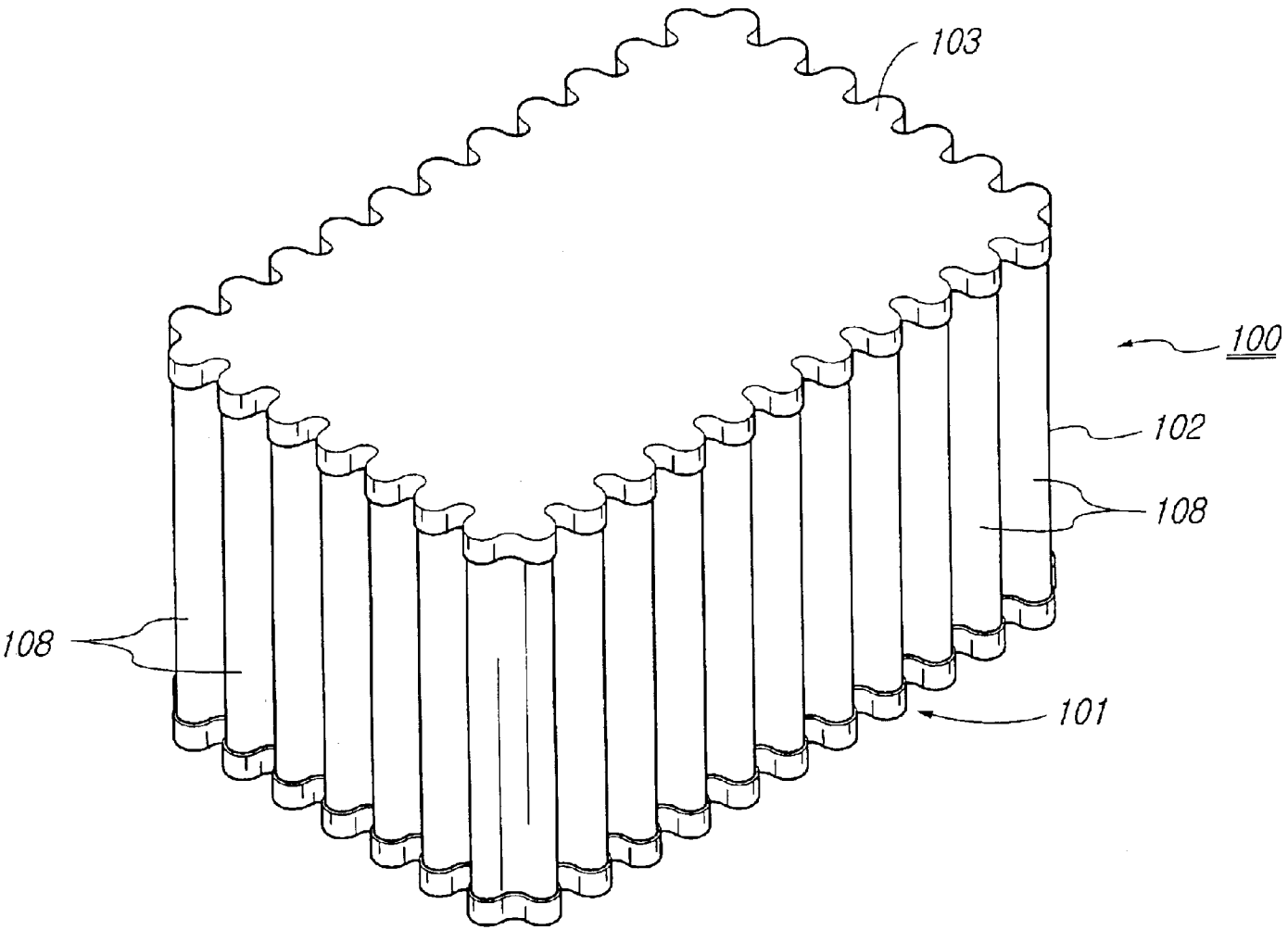
FIG. 18 is a cross-sectional view of a device for cooling a high voltage transformer for a microwave oven in accordance with a fourth embodiment of the present invention.

FIG. 9 is a partially broken-away perspective view of a device for cooling a high voltage transformer for a microwave oven in accordance with a second embodiment of the present invention. FIG. 10 is a cross-sectional of the device for cooling the high voltage transformer for the microwave oven, in which inner components are omitted, taken along the line C—C, of FIG. 9. FIG. 11 is an enlarged cross-sectional view of an example of the portion D of the device for cooling the high voltage transformer for the microwave oven of FIG. 9, and FIG. 12 is an enlarged cross-sectional view of another example of the portion D of the device for cooling the high voltage transformer for the microwave oven of FIG. 9. FIG. 13 is an enlarged cross-sectional view of an example of the portion E of the device for cooling the high voltage transformer for the microwave oven of FIG. 9, and FIG. 14 is an enlarged cross-sectional view of another example of the portion E of the device for cooling the high voltage transformer for the microwave oven of FIG. 9. FIG. 15 is an enlarged cross-sectional view of an example of the portion F of the device for cooling the high voltage transformer for the microwave oven of FIG. 9, and FIG. 16 is an enlarged cross-sectional view of another example of the portion F of the device for cooling the high voltage transformer for the microwave oven of FIG. 9. FIG. 17 is a cross-sectional view of a device for cooling a high voltage transformer for a microwave oven in accordance with a third embodiment of the present invention. FIG. 18 is a cross-sectional view of a device for cooling a high voltage transformer for a microwave oven in accordance with a fourth embodiment of the present invention.

In accordance with the second embodiment of the present invention, there is provided a device for cooling the high voltage transformer 50 by inserting the high voltage transformer 50 into the container 51 so as to more easily cool the cooling oil 54 absorbing the heat of a high temperature generated from the coil 56 and the core 57, to more effectively treat the electric connection lines 60 leading from the high voltage transformer 50, and to improve a fixed structure of the container 51.

For this purpose, the container 51 comprises a base 101, a case 102, and a cover 103. Corrugated portions 108 with concave portions 106 and convex portions 107 in a semicircular shape are formed on each of side surfaces of the case 102 of the container 51, thereby more rapidly cooling the cooling oil 54 absorbing the conducted heat by convection current.

Instead of the aforementioned semicircular shape, each of the corrugated portions 108 may have various shapes such as rectangle, triangle, etc., as long as the corrugated portions 108 include the concave portions 106 and the convex portions 107 arranged in a horizontal direction of the side surfaces 105 of the case 102.

Alternatively, the corrugated portions 108 may include the concave portions 106 and the convex portions 107 arranged in a vertical direction of the side surfaces 105 of the case 102, as shown in FIG. 18.

The electrical connection lines 60 leading from the high voltage transformer 50 pass through via holes 111 formed through a cover 103, each hole being provided with a protrusion 110. A bush 112 for protecting the corresponding electrical connection line 60 is inserted into the via holes 111.

The insides of the protrusions 110 are filled with an epoxy 113 so as to prevent the cooling oil 54 from flowing thereinto through the via holes 111 and the bushes 12.

The bush 112 may be inserted into the via hole 111 from the inside of the protrusion 110 as shown in FIG. 11, or from the outside of the protrusion 110 as shown in FIG. 12.

The case 102 and the base 101 of the container 51 are fixed to each other by tightly jointing the case 102 and the base 101 with each other and then by welding designated portions of the jointed case 102 and base 101 by brazing, arc welding, or electric welding.

The high voltage transformer 50 is fixed to the base 101 by argon welding the high voltage transformer 50 mounted on the base 101 via weld holes 115 formed through the base 101.

The case 102 and the cover 103, and the case 102 and the base 101 are respectively fixed to each other by forming curling portions 116 on the upper end of the case 102 and the edge of the cover 103, and on the lower end of the case 102 and the edge of the base 101, by engaging the curling portions 116 with each other, and by pressing the engaged portions. In order to more firmly fix the case 102 and the cover 103, and the case 102 and the base 101 to each other, if necessary, after the pressing step, a welding step may be further performed.

Instead of the auxiliary cooling means 80 for improving the cooling effect in the container 51 of the first embodiment, a plurality of heat pipes 120 for circulating a refrigerant introduced thereinto so as to cool the heat are installed in the container 51, thereby improving the cooling of the container 51.

Preferably, radiation fins 121 are fixed to portions of the heat pipes 120 exposed to the outside, thereby improving the cooling effect.

As described above, in the present invention, the high voltage transformer 50 is inserted into the container 51, the cooling oil 54 is injected into the container 51, and the container 51 is covered with the cover 52. Then, the container 51 incorporating the high voltage transformer 50 is installed in products such as microwave ovens.

In accordance with the first embodiment, power is inputted to and outputted from the high voltage transformer 50 so as to operate the high voltage transformer 50 via the terminals 61 provided on the upper part of the cover 52.

In accordance with the second embodiment, the electrical connection lines 60 leading from the high voltage transformer 50 and having a connection part at their ends are protruded from the cover 103 and exposed to the outside, thereby improving the connection of the high voltage transformer 59 and an end product requiring the high voltage transformer 59.

In case the electrical connection lines 60 are protruded from the cover 103 and are exposed to the outside, since the bushes 112 and epoxy 113 are used as means for preventing the cooling oil 54 from flowing thereinto through via holes 111 formed through the cover 103, reduction of the cooling effect due to the leakage of the cooling oil 54 is prevented.

The above-described high voltage transformer 50 of the present invention is installed on the end product. Then, the cooling oil 54 filling the interior of the container 51 absorbs the heat of a high temperature generated from the coil 56 and the core 57, and then conducts the absorbed heat to the container 51.

The heat conducted to the container 51 is rapidly cooled by means of the heat exchange by the operation of the blast fan installed on the outside of the container 51.

Particularly, since the interior of the container 51 is filled with the cooling oil 54, the cooling oil 54 reaches deep into the coil 56 and the core 57 so as to absorb the heat generated therefrom in operating the high voltage transformer 50. In the first embodiment, the cooling effect is further improved by the auxiliary cooling means 80 such as the folds 81 or the radiation fins 82 formed integrally with the container 51.

In the second embodiment, when the cooling oil 54 absorbing the heat conducted from the coil 56 and the core 57 reaches the convex portions 107 of the corrugated portions 108 formed on each side surface 105, outwardly protruding from the side surfaces 105, since the cooling oil 54 within the concave portions 107 are circulated by convection current, the cooling effect is further improved.

Further, in case the heat pipes 120 serving as the auxiliary cooling means are fixed within the container 51 and partially protruded to the outside, since the protruded portions of the heat pipes 120 are rapidly cooled by the blast fan, the heat exchange between the protruded portions and internal portions of the heat pipes 120 is improved and the cooling effect is also improved.

The fixing means 65 prevents the movement of the high voltage transformer 50 inserted into the container 51 due to the vibration generated in operating the high voltage transformer 50. Such function of the fixing means 65 will be described as follows.

In the first embodiment, when the high voltage transformer 50 is mounted on the bottom 71 of the container 51 by means of the lower guide 66 interposed between the bottom 71 of the container 51 and the lower surface of the high voltage transformer 50, the lower and upper guides 66 and 67 prevent the movement of the high voltage transformer 50, i.e., fix the high voltage transformer, thereby allowing the cooling oil 54 to freely circulate in the space between the container 51 and the fixed high voltage transformer 50.

In the second embodiment, the high voltage transformer 50 is fixed to the base 101 by welding the high voltage transformer 50 into the base 101 via the weld holes 115 formed through the base 101. Although the cooling device of the second embodiment does not have the lower and upper guides 66 and 67, the movement of the high voltage transformer 50 due to the vibration generated in operating the high voltage transformer 50 is sufficiently prevented and simultaneously the high voltage transformer 50 is grounded.

In accordance with the present invention, since the container 51 incorporating the high voltage transformer 50 is filled with the cooling oil 54 and sealed, the container 51 maximizes its cooling effect, and reduces the size of the high voltage transformer 50 compared to a conventional high voltage transformer with the same capacity as the transformer 50 of the present invention.

Further, since the high voltage transformer 50 is not exposed to the outside, the high voltage transformer 50 is not disclosed to high voltage in inspecting and repairing peripheral parts, thereby protecting users from dangers such as an electrical shock.

As apparent from the above description, the present invention provides a method and a device for cooling a high voltage transformer for a microwave oven, in which the high voltage transformer is sealed so as to separate a coil and a core from the outside and to improve a cooling effect, and in which electric connection lines leading from the high voltage transformer are effectively treated and a fixed structure of a container for accommodating the high voltage transformer is improved so as to protect users of the high voltage transformer from dangers such as an electrical shock occurring in inspecting the microwave oven, thereby improving performance and quality of the microwave oven and the high voltage transformer.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for cooling a high voltage transformer for a microwave oven, comprising:

a container for accommodating the high voltage transformer;

corrugated portions with concave portions and convex portions, formed on each of side surfaces of a case of the container and separated from each other by the same distance so as to more rapidly cool a cooling oil absorbing heat conducted thereto by convection current;

electrical connection lines leading from the high voltage transformer, passing through via holes formed through a cover of the container, each of the said via holes being provided with a protrusion, and protruding to the outside of the cover;

bushes inserted into each of the via holes so as to protect the connection wires; and an epoxy filling the insides of the protrusions so as to prevent the cooling oil from flowing thereinto.

2. The device for cooling a high voltage transformer for a microwave oven as set forth in claim 1, wherein the corrugated portions are horizontally arranged on each of the side surfaces of the container.

3. The device for cooling a high voltage transformer for a microwave oven as set forth in claim 1, wherein the corrugated portions are vertically arranged on each of the side surfaces of the container.

4. The device for cooling a high voltage transformer for a microwave oven as set forth in claim 1, wherein the case of the container is fixed to a base of the container by tightly jointing the case with the base and by welding the case into the base by brazing.

5. The device for cooling a high voltage transformer for a microwave oven as set forth in claim 1, wherein the high voltage transformer is fixed to a base of the container by argon welding the high voltage transformer mounted on the base into the base via weld holes formed through the base.

6. The device for cooling a high voltage transformer for a microwave oven as set forth in claim 1, wherein the case and the cover, and the case and a base of the container are respectively fixed to each other by forming curling portions on the upper end of the case and the edge of the cover, and on the lower end of the case and the edge of the base, by engaging the curling portions with each other, by pressing the engaged portions, and by welding the pressed portions.

7. The device for cooling a high voltage transformer for a microwave oven as set forth in claim 1, further comprising auxiliary cooling means formed on the external surface of the container so as to rapidly cool the cooling oil absorbing heat generated from the coil and the core.

* * * * *